United States Patent [19]

Yumoto

[11] 4,195,742

[45] Apr. 1, 1980

[54] COUPLER FOR TOY AND MODEL RAILWAY CARS

[75] Inventor: Yoshihide Yumoto, Tokyo, Japan

[73] Assignee: Tomy Kogyo Co., Inc., Tokyo, Japan

[21] Appl. No.: 865,195

[22] Filed: Dec. 28, 1977

[30] Foreign Application Priority Data

Oct. 11, 1977 [JP] Japan ..... 52/121655

[51] Int. Cl.[2] ..... B61G 1/02; B61G 7/04

[52] U.S. Cl. ..... 213/75 TC; 46/216; 213/75 D; 213/211

[58] Field of Search ..... 213/75 A, 75 R, 75 TC, 213/75 D, 211, 212, 159, 164, 165, 172, 173, 101; 46/216, 217

[56] References Cited

U.S. PATENT DOCUMENTS

| | | | |
|---|---|---|---|
| 115,627 | 6/1871 | Meier | 101/213 |
| 3,840,127 | 10/1954 | Edwards | 213/75 TC |
| 3,942,648 | 3/1976 | Edwards et al. | 213/75 TC |

*Primary Examiner*—Charles E. Frankfort
*Assistant Examiner*—Frank Atwood
*Attorney, Agent, or Firm*—Kenway & Jenney

[57] ABSTRACT

A coupler for toy and model railway cars includes a pivotable coupler member having a coupler knuckle adapted to engage a complementary knuckle on an adjacent car. The coupler member is mounted for pivoting movement between a lower position substantially parallel to a trackway and an upper position and is normally maintained in the lower position by magnetic attraction existing between two permanent magnets secured, respectively, to the coupler member and to a support. Cars may be uncoupled by providing a pole of an uncoupling magnet on the trackway to attract at least one pole of the coupler member magnet to torque the knuckle to the upper position and thereby effect uncoupling. The coupler knuckle includes a projection formed on its lower side which is adapted to engage and hold the adjacent complementary coupler knuckle when cars are being pulled in a normal running mode to prevent the knuckles from unintentionally disengaging when coupled cars pass over the uncoupling magnet. The coupler member also includes an inclined ramp surface on the lower surface of a support shaft. When a coupler member is in its upper position, the inclined ramp surface is adapted to contact the fore end of the complementary knuckle to permit one car to push an adjacent car without the cars being coupled to one another. Cars may be pushed to a desired location and left by the pushing car without recoupling of the knuckles.

32 Claims, 12 Drawing Figures

COUPLER FOR TOY AND MODEL RAILWAY CARS

BACKGROUND OF THE INVENTION

The present invention relates to improved coupler mechanisms for coupling and uncoupling toy and model railway cars, or the like, and, more particularly, to couplers utilizing the principles of like magnetic poles attracting and unlike poles repelling as a means for effecting smooth and reliable coupling and uncoupling between cars.

The present invention provides couplers for toy and model railway cars having means by which adjacent coupled cars will not be unintentionally uncoupled during the normal running mode when the cars are pulled over an uncoupling magnet located in the trackway.

The present invention also provides couplers for toy and model railway cars having means by which a car may be pushed by an adjacent car without being coupled thereto to a predetermined location, and left by the pushing car without any unintentional recoupling.

The coupler of the present invention permits toy and model railway cars to be reliably coupled and uncoupled, pushed to selected locations, such as a siding, shunted, and the like by remote control thereby resulting in increased enjoyment for the user.

The construction and operation of toy and model railway cars is a worldwide hobby of significant economic consequence. Model railway cars utilize coupling mechanisms located at the ends of each car to effect the coupling and uncoupling of adjacent cars. Ordinary coupling mechanisms have been characterized by troublesome and unreliable operation giving rise to a need, especially with regard to the smaller scale model railway couplers, for a simple, inexpensive coupler which can be controlled in a remote manner to provide reliable coupling and uncoupling.

One widely used coupling mechanism is the "Arnold-type" shown in FIGS. 1 and 2, and generally referred to therein by the reference character 10. The coupler 10 includes a conventional "C" shaped coupler knuckle 11 secured to an end of a support shaft 12, and a flange 13 formed at and extending laterally outward of the other end of the shaft 12. The knuckle 11 includes a triangular formation 19 at its forward end having upper and lower inclined ramp surfaces. The flange end of the support shaft 12 is pivotably retained in a pocket 21 formed in a support means 15 secured to the end of the car 14 (broken lines illustration). The flange 13 is resiliently urged by a helical spring coil 17, in compression, against a forward inner wall 18 of the support means 15. The knuckle 11 is mounted so that it may pivot in a vertical plane between a lower position substantially parallel to a trackway 20 and an upper position (FIG. 2) with the spring 17 resiliently urging the knuckle 11 to the lower position. In order to couple adjacent cars together, the cars are thrust toward one another causing one of the two knuckles to ride upwardly on the upper inclined ramp surface of the other knuckle. In the case shown in FIG. 2, the knuckle 11 is forced to its upper position by the upper inclined ramp surface of the complementary knuckle 11'. The upwardly pivoted knuckle 11 then clears the horizontally aligned knuckle 11' and is resiliently urged by the spring 17 to the lower position to couple with the knuckle 11'. The cars may be readily uncoupled by providing a depending pin, 16 and 16', on each knuckle, 11 and 11', and an uncoupling means 22 which may be selectively caused to project or extend upwardly from the trackway 20 to contact one of the depending pins to force the associated knuckle to its upper position to disengage the knuckles 11 and 11' and thereby uncouple the cars.

There are a number of disadvantages associated with the above described coupler. The spring 17 can twist and thereby diminish the ability of the spring 17 to maintain the knuckles 11 and 11' in their normal positions. In addition, cases can arise where the spring 17 provides an excessive force, making coupling action uncertain. Also, when adjacent coupled cars are uncoupled, it is necessary to precisely control the running and stopping of the cars along the trackway such that the uncoupling means 22 may properly cooperate with the depending pins to effect the uncoupling. This precise running and stopping operation is difficult to achieve in the case of the smaller scale model railway cars and has greatly reduced the uncoupling reliability. As can be appreciated, the above described disadvantages reduce the recreational enjoyment one may derive from the operation of toy and model railway cars.

Other prior art coupler mechanisms are known which employ permanent magnets to assist in the uncoupling function. In these coupling mechanisms, insufficient consideration has been given to the location of the magnets, the alignment and utilization of the magnetic lines of force, and the support means. An example of one such coupler mechanism is disclosed in U.S. Pat. No. 3,840,127 to Edwards in which magnetic repulsion is used during the uncoupling operation. A permanent magnet is affixed to the knuckle of an conventional coupler to provide a means for magnetically uncoupling the cars. The magnet is aligned on the knuckle with the polar axis vertical and with one pole facing downward toward the trackway. A selectively actuatable uncoupling electromagnet is located beneath the trackway with a like pole on the trackway facing upwardly toward the downwardly facing pole of the knuckle magnet. The cars are coupled as described above for the "Arnold-type" coupler and may be uncoupled by selectively energizing the uncoupling electromagnet to cause a resultant magnetic repulsion between the like poles of the uncoupling and knuckle magnets to pivot the knuckle to its upper position and thereby effect uncoupling.

Because of the vertical alignment of the magnets, the magnetic lines of forces are directed generally vertically upward at the center of the magnet, upward and inclining to the left on the left-hand portion of the magnet, and upward and inclining to the right on the right-hand portion of the magnet. When the coupling magnet is urged to its upward position as a result of the repulsion between the two magnets, both the direction and magnitude of the resultant magnetic force varies as the coupler pivots upwardly. Thus, the force driving the coupler upward differs depending upon its relative position with respect to the uncoupling magnet. This force variation makes smooth and reliable upward pivoting of the coupling member and, consequently, uncoupling uncertain.

In another type of prior art coupler, a permanent uncoupling magnet, rather than a selectively actuatable electromagnet, is located in the trackway to cooperate with a permanent magnet mounted on the pivotable coupler member. Cars may be uncoupled by stopping them within the effective range of the uncoupling magnet, which then co-acts with at least one pole of the coupler magnet to pivot the coupler member upward to effect the uncoupling. A disadvantage of this type of coupler, resulting from the permanent nature of the uncoupling magnet's field, is that cars may be unintentionally uncoupled when they are driven over the uncoupling permanent magnet during the normal running mode. As can be appreciated, this undesired uncoupling reduces the recreational enjoyment one may derive from the operation of toy and model railway cars.

From the hobbiest standpoint, it is often desirable to perform the delayed uncoupling (DU) operation in which two adjacent cars are uncoupled by a trackway magnet and one of the cars used to push the other, uncoupled car, to a selected track location, such as a siding or the like. The pushing car is then separated from the driven car without recoupling. In the known prior art couplers, there are no means for effecting the delayed uncoupling operation in a simple, convenient, and reliable manner.

SUMMARY OF THE INVENTION

It is an object of the present invention to provide an improved coupler mechanism for toy and model railway cars which overcome the drawbacks of the prior art, in which coupling, normal running, uncoupling, the pushing to and leaving of cars at a selected location, car shunting, and the like can be performed easily and reliably and within the fundamental forward-reverse and speed control performance ranges of toy and model railway cars.

It is another object of the present invention to provide a coupler mechanism for toy and model railway cars which includes means to prevent coupled cars from unintentionally disengaging when the cars are pulled or run over an uncoupling permanent magnet located in a trackway.

It is still another object of the present invention to provide a coupler mechanism having means by which a car may be pushed or driven by another car without being coupled thereto, and then left at a selected track location without recoupling to the pushing car.

Toward the fulfillment of these objects, and others, the present invention provides a coupler for coupling and uncoupling toy and model railway cars having a coupler knuckle pivotably mounted on a support means and adapted to pivot between a lower position for coupling and a upper position for uncoupling. Means are provided to resiliently urge the coupler knuckle to its lower coupling position.

Holding means, which may take the form of a projection formed in the lower side of the coupler, are provided to prevent movement of the coupler to its upper uncoupling position when the cars are on a normal running mode.

In addition, means, which may take the form of an inclined ramp surface on the lower side of the coupler knuckle support shaft, are provided to contact the fore end of the complementary coupler when one coupler is in its upper position to permit a car to push or drive another car to a selected track location, and then separate from and leave the driven car without recoupling.

DESCRIPTION OF THE FIGURES

The above description as well as the objects, features, and advantages, of the present invention will be more fully appreciated by reference to the following detailed description of presently preferred but nonetheless illustrated embodiments in accordance with the present invention, when taken in conjunction with the accompanying drawings wherein.

DESCRIPTION OF THE PREFERRED EMBODIMENT

Figure 1:
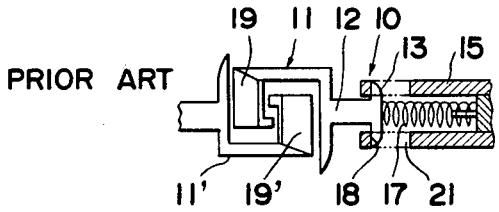
FIG. 1 is a plan view, in partial cross section, of a conventional coupler mechanism.
Figure 2:
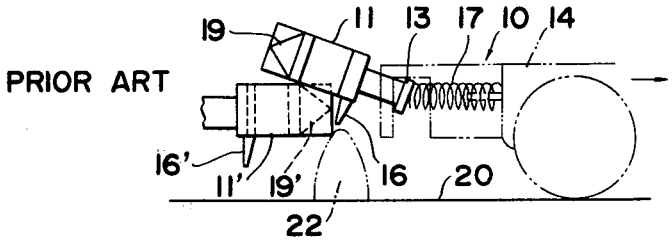
FIG. 2 is a side elevation view of the coupler shown in FIG. 1 with a coupler knuckle shown in an upper position and selected portions shown in broken-line illustration.
Figure 3:
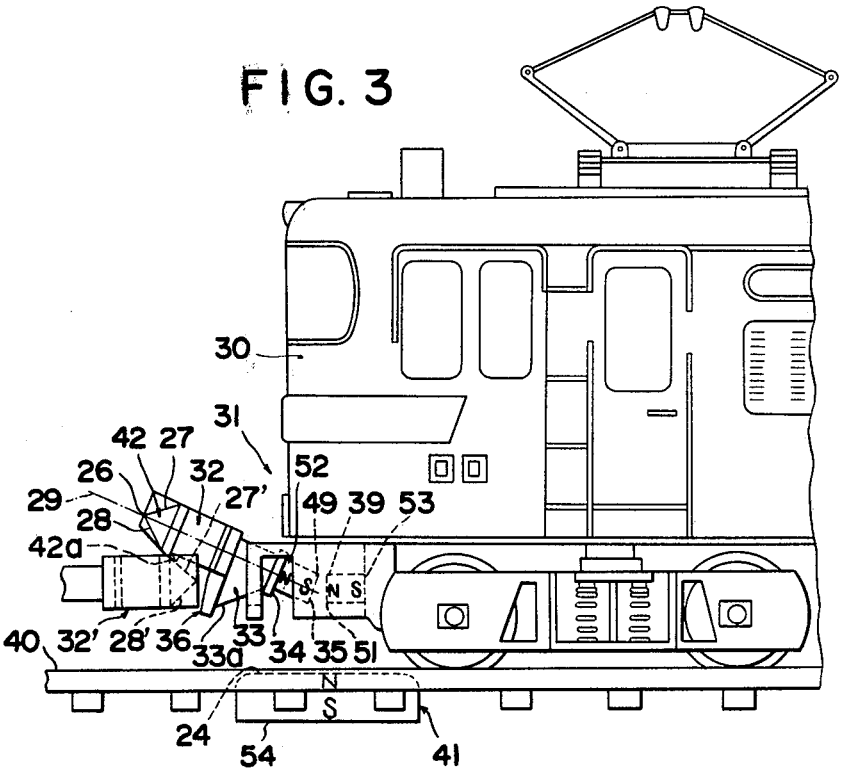
FIG. 3 is a side elevation view of a model railway car having a coupler embodying the present invention secured thereto with the coupler knuckle shown in the upper position.
Figure 4A:
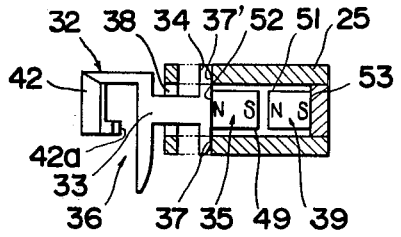
FIG. 4*a* is a plan view, in partial cross section, of the coupler shown in FIG. 3.
Figure 4B:
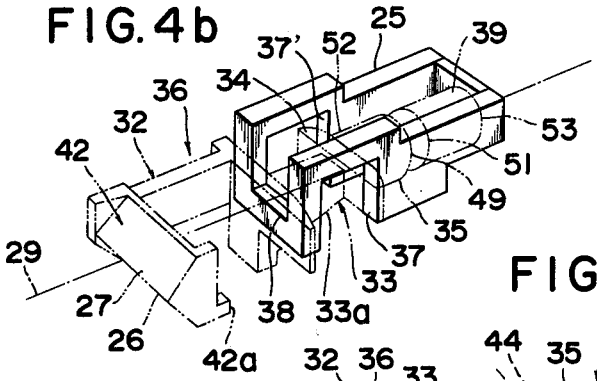
FIG. 4*b* is a perspective view of the coupler shown in FIG. 4*a* with selected portions shown in broken line illustration.

As shown in FIGS. 3, 4*a* and 4*b*, the reference character 31 refers in general to a coupler of the present invention mounted at the end portion of a model railway car 30, such as a locomotive or engine or a car coupled to an engine or locomotive. The car 30, in response to remote control signals, may be operated at varying speeds in the forward and reverse directions, and is adapted to pull one or more cars coupled together in a normal forward running mode as well as push one or more cars. The coupler 31 is formed generally along a longitudinal axis 29 and includes a "C" shaped coupler knuckle 32 secured to one end of a support shaft 33. The knuckle 32, which is adapted to engage or mesh with a complementary knuckle 32' on an adjacent car (not shown), includes a triangular formation 42 having inclined upper and lower ramp surfaces, 27 and 28, intersecting at an edge 26 at the fore end of the coupler 31. A rectangular flange 34 is formed at and extends laterally outward of the other end, that is, the rear end, of the support shaft 33.

A projection 42*a* is formed on the inner, lower side portion of the formation 42 and is directed toward the rear end of the coupler 31. This projection functions, as described below, to prevent a trackway mounted uncoupling permanent magnet from unintentionally causing a coupler 31 to pivot to its upper position to uncouple adjacent cars when the cars are being pulled over the uncoupling magnet by the car 30 during the normal running mode.

Figure 9:
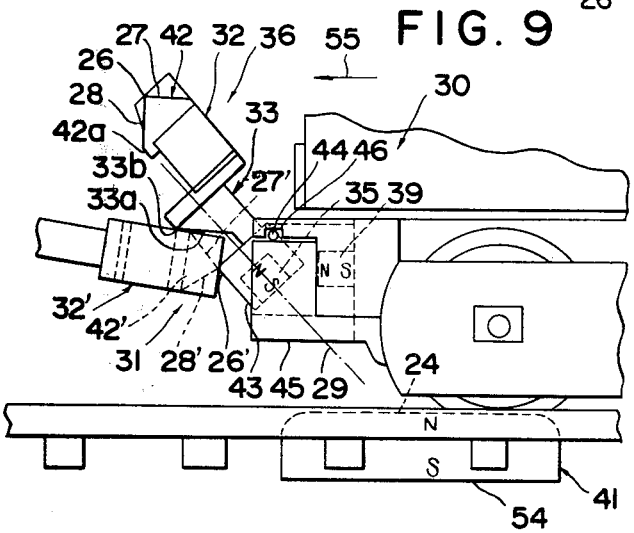
FIG. 9 is a partial side elevation view of a model railway car, similar to FIG. 7, with the coupler knuckle shown in the upper position and with another knuckle engaging an inclined surface of the raised knuckle.

The coupler 31 also includes an inclined ramp surface 33*a* formed on the lower side of the support shaft 33. The ramp surface 33*a* is adapted, as described below, to contact the fore end of a complementary coupler knuckle 32' when the coupler 31 is in its upper position to permit the car 30 to push the adjacent car without being coupled thereto, and then to separate from and leave the adjacent car without recoupling. As shown in FIG. 9, the ramp surface 33*a* becomes substantially horizontal (that is, substantially parallel to the trackway 40) when it is engaging the fore end of the adjacent coupler knuckle 32' to permit the car 30 to push the adjacent car.

The coupler 31 is pivotaly retained at its flange end in a pocket 38 (FIGS. 4*a* and 4*b*) of a support structure 25 having open front and upper portions and having spaced apart vertical end walls 37 and 37'. The coupler 31 and its knuckle 32 are pivotally supported for movement between a lower position substantially parallel to the trackway 40 and an upper position (FIG. 3).

A permanent magnet 35, preferably in the form of a bar magnet having a rectangular or circular cross section, is secured to the flange end of the support shaft 33 with its polar axis preferably coincident with the longitudinal axis 29 of the coupler 31 and with one of its poles 49 facing outwardly and to the rear of the coupler 31 along the longitudinal axis 29.

A second permanent magnet 39, preferably having the same general shape as the magnet 35, is secured to the support structure 25 with one of its poles 51 facing towards the outwardly facing rear pole 49 of the magnet 35. The magnet 39 is stationary with respect to the magnet 35 and is preferably located on the support structure 25 such that its polar axis is substantially coincident with the longitudinal axis 29 of the coupler 31 when the coupler 31 is in its lower position.

The magnets 35 and 39 are so oriented that unlike poles face toward one another. In the case of the embodiment shown in FIGS. 3 and 4*a*, the rear pole 49 of the magnet 35 is a south pole and the pole 51 of the magnet 39 is a north pole. The magnetic attraction that results between the unlike poles of the magnets 35 and 39 causes the flange end of the shaft 33 to be resiliently urged against the end walls 37 and 37' to thereby cause the knuckle 32 to be resiliently urged to its lower position. As can be appreciated, the reverse pole arrangement for the magnets 35 and 39 is equally satisfactory.

Cars utilizing the structure described above may be coupled together by thrusting the cars toward one another as shown in FIG. 3. One of the knuckles, for example knuckle 32 is driven upward on the upper inclined ramp 27' of the complementary knuckle 32' to its upper position and is then resiliently urged by the magnetic attraction force between the magnets 35 and 39 to its lower position to thereby couple the cars.

The cars may be uncoupled by means of an uncoupling magnet 41 (FIG. 3), which is preferably a permanent magnet but which may also take the form of a selectively acutatable electromagnet, mounted beneath the trackway 40. The uncoupling magnet 41 is preferably mounted such that its polar axis is vertically aligned with one of its poles 24 located on the trackway 40 facing upwardly toward the outwardly facing pole 49 of the magnet 35. The uncoupling magnet 41 is so oriented that the pole 24 is unlike the outwardly facing pole 49 of the magnet 35 and produces a substantially stronger magnetic field, that is, a substantially greater magnetic flux, than the magnet 39. In the preferred embodiment shown in FIG. 3, the pole 24 is a north pole. When it is desired to uncouple cars, they are positioned over the uncoupling magnet 41. The north pole 24 attracts the outwardly facing south pole 49 and repels the north pole 52 of the magnet 35 to generate a force at the flange end of the coupler 31 which torques the coupler 31 upward to its upper position as shown in FIG. 3 to thereby uncouple the cars.

Figure 4C:
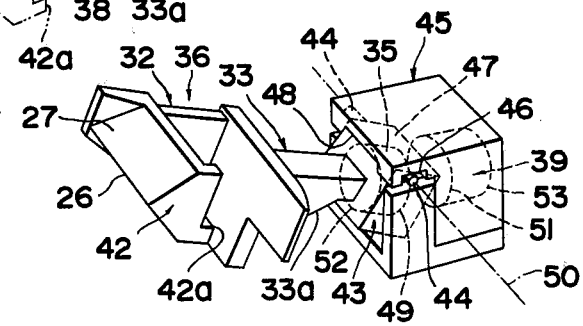
FIG. 4*c* is a perspective view of another coupler embodying the present invention, shown with the coupler knuckle in the upper position.

Another embodiment of the coupler is shown in FIG. 4*c* in which a coupler member 36 has a boxlike receptacle 43 formed at the rear end of the support shaft 33 and into which the magnet 35 is inserted. Shaft-like projections 44 extend laterally outward from each side of the receptacle 43 along a lateral axis 50 and are received in bearing bores 46 formed in the side walls of the support 45. Each bore 46 is preferably enlarged horizontally, that is, elongated to define horizontal slots, the length of which is substantially larger than the diameter of the projections 44. The elongated bores 46 permit limited lateral pivoting of the knuckle 32 in a plane passing through the lateral axis 50. An upper wall 47 of the receptacle 43 is adapted to contact a ceiling 48 of the support 45 to limit the downward pivoting of the coupler 31. The embodiment of FIG. 4*c* permits the coupler 31 to pivot between its lower and upper positions in a smooth uniform manner when compared to the embodiment utilizing in the aforementioned pivoting flange structure.

In the embodiments described above, both poles of the magnet 35 are located on one side of the lateral pivoting axis of the coupler 36. During the uncoupling operation, the outwardly facing south pole 49 of the magnet 35 is attracted to the north pole 24 of the uncoupling magnet 41 to provide a torque to pivot the knuckle 32 to its upper position, and the north pole 52 of the magnet 35 is repelled by the north pole 24 to provide a counter torque to pivot the coupler downward to its lower position. Since the north pole 52 of the magnet 35 is closer to the pivoting axis, the counter torque produced by the repulsion force between the poles 52 and 24 is small and can be considered negligible.

Figure 5:
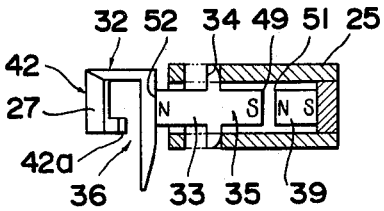
FIG. 5 is a plan view, in partial cross section, of a variation of the coupler shown in FIG. 4*a;*
Figure 6:
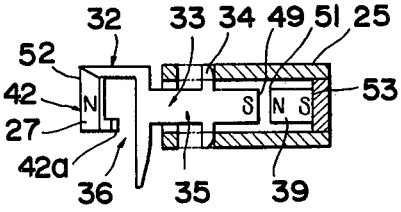
FIG. 6 is a plan view, in partial cross section, of another variation of the coupler shown in FIG. 4*a.*

As shown in FIGS. 5 and 6, it is readily possible to increase upward pivoting torque acting on the coupler by positioning one pole of the magnet 35 on one side of the pivoting axis and the other pole on the other side of the pivoting axis. In FIG. 5 the support shaft 33 is formed as a magnetic member with the pole 49, the south pole, facing outwardly toward the magnet 39 and the other pole 52, the north pole, at the other end of the support shaft 33, contiguous with the knuckle 32. This embodiment may be fabricated by forming the support shaft 33 from a ferro-magnetic material or affixing a bar magnet to a support shaft 33 fabricated from a nonmagnetic material. The embodiment shown in FIG. 6 is similar to that shown in FIG. 5, except that north pole 52 is located at the fore end of the knuckle 32. This embodiment may be fabricated by forming the entire knuckle 32 and the support shaft 33 as a unitary structure from a ferro-magnetic material. As can be appreciated, the attraction/repulsion force couple which results when the poles are located on opposite sides of the pivoting axis is greater than that of the embodiments illustrated in FIGS. 3, 4*a*, 4*b*, and 4*c*.

Toy and model railway cars utilizing the embodiments of the present invention described above may be coupled together by thrusting or driving the cars towards one another in a manner similar to that described for the conventional "Arnold-type" coupler mechanism. Initially, the coupler knuckles 32 and 32' are maintained in a horizontal position, that is, substantially parallel to the trackway, by the mutual attraction between the permanent magnet 35 at the rear end of each coupler member 36 and the respective stationary permanent magnet 39. When the "C" shaped coupler knucklers 32 and 32' contact each other, one of the knuckles, for example, knuckle 32, will ride up onto the upper ramp 27' of the horizontal knuckle 32' until it clears the knuckle 32' and then is resiliently urged by the magnetic attraction between the magnets 35 and 39 to its lower position to thereby couple the cars. The use of magnetic attraction to urge the knuckle 32 to the lower position results in the smooth and rapid returning of the knuckle 32 to its lower position and provides long term coupling reliability.

When a coupler mechanism of the type illustrated in FIGS. 3–4*b* is in a normal coupled state with another coupler, the magnetic attraction which occurs between the rear pole 49 (south pole) of the permanent magnet 35 and the fore pole 51 (north pole) of the stationary magnet 39 urges the flange 34 against the vertical end walls 27 and 37' of the pocket 38 to maintain the C-shaped coupler 32 in the horizontal position. In order to effect uncoupling, the cars are moved to position the coupler 31 above and within the effective range of the uncoupling magnet 42 such that the permanent magnet 35 is influenced by the magnetic field arising from the uncoupling magnet 41. The rear pole 49 (south pole) of the permanent magnet 35 is attracted by the unlike upper pole 24 (north pole) of the magnet 41 to cause the flange 34 to pivot in a clockwise direction (in FIG. 3) in the pocket 38, which contains sufficient clearance to accommodate the pivoting flange 34. The C-shaped coupler knuckle 32 pivots to its upper position thereby disengaging from the adjacent complementary C-shaped coupler knuckle 32'. When the uncoupled car 30 is moved out of the effective range of the magnetic field of the uncoupling magnet 41, the permanent magnet 35 is again attracted by the stationary permanent magnet 39, to urge the knuckle 32 towards its lower horizontal position.

When a coupler mechanism of the type illustrated in FIG. 4*c* is in a normal coupled state with another coupler, the rear pole 49 of the permanent magnet 35 is attracted by the fore pole 51 of the stationary permanent magnet 39 to urge the coupler 32 to the lower horizontal position and to cause the upper surface 47 of the receptacle 43 to contact the ceiling 48 of the support 45. In order to effect uncoupling the coupled cars are moved to position the coupler 36 above and within the effective range of the uncoupling magnet 41 such that the permanent magnet 35 is influenced by the magnetic field arising from the uncoupling magnet 41. The rear pole 49 of the permanent magnet 35 is attracted by the north pole of the magnet 41, thereby causing the coupler member 36 to pivot in a clockwise direction about its axis 50 and causing the projections 44 to rotate in their bearing bores 46. The coupler knuckle 32 is rotated to its upper position to thereby effect uncoupling. After the uncoupled car 36 is moved out of the effective range of the magnetic field of the uncoupling magnet 41, the pole 49 of the permanent magnet 35 is again attracted by the pole 51 of the magnet 39 to resiliently urge the coupler 32 to its horizontal or lower position and cause the upper surface 47 of the receptacle 43 to again contact the ceiling 48 of the support structure 45. The embodiment of FIG. 4*c* permits the coupler 36 to pivot between its lower and upper positions in a smooth uniform manner with a minimum of twisting motion and provides for a more reliable and stable horizontal position of the knuckle 32 when compared to the embodiment utilizing the aforementioned pivoting flange structure.

The coupling function of the embodiments illustrated in FIGS. 5 and 6 are similar to that described above for the embodiments of FIGS. 3–4*c*. The pole 39 of the permanent magnet 35 is attracted to the pole 41 of the magnet 39 to resiliently urge the coupler knuckle 32 towards the lower position. When the coupled cars are moved into the effective range of the magnetic field of the uncoupling magnet 41, the rear pole 49 (south pole) is attracted by the north pole 24 of the uncoupling magnet 41 and, concurrently therewith, the fore pole 52 (north pole) is repeled. As a result of this attraction/-repulsion interaction between the magnets 35 and 41, a torque arises to cause the coupling member 36 to pivot to its upper position. Because the poles of the coupler magnet 35 are located on opposite sides of the lateral pivoting axis, the torque applied to the coupling member 36 is about twice as large as the torque applied to the above described coupler structures. In addition, the torque applied to the coupling member 36 of the embodiment of FIG. 6 is larger than that of the embodiment of FIG. 5 because of the additional distance between the fore end north pole 52 and the pivoting axis. Consequently, relatively large torques can be applied to the pivotable coupling member 36 by the uncoupling element 41 when the poles of the coupling member magnet 35 are on opposite sides of the lateral pivoting axis. Convenient and reliable disengaging can thus be obtained even if there are forces, such as frictional forces, which resist the uncoupling torque.

The projection 42*a*, which is provided on the lower end surface of the coupler knuckle 32 of the car 30 is provided to prevent or inhibit adjacent coupled cars from unintentionally uncoupling when the cars are pulled or dragged over the uncoupling magnet 41 during the normal running mode.

Figure 7:
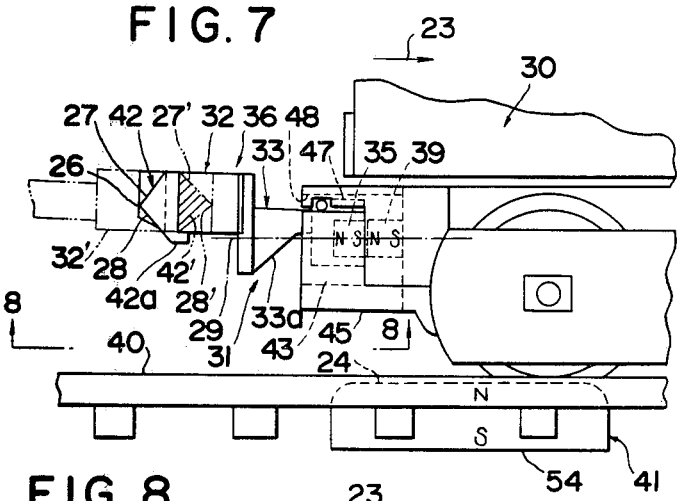
FIG. 7 is a partial side elevation view of a model railway car having the coupler shown in FIG. 4*c* secured thereto with the coupler knuckle shown in a lower position.
Figure 8:
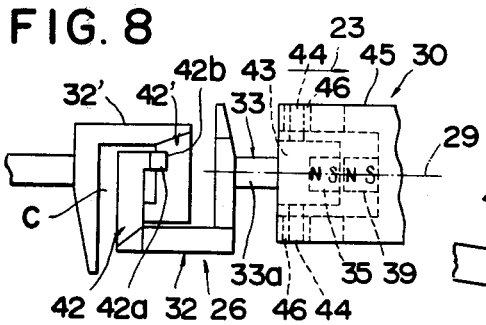
FIG. 8 is a bottom view of the coupler shown in FIG. 7 taken along line 8—8 of FIG. 7.

FIG. 7 shows a car 30, such as an engine, coupled to an adjacent car (not shown) with couplers of the type shown in FIG. 4*c*. The car 30 is pulling the adjacent car in the direction of the arrow 23 towards the uncoupling permanent magnet 41. The C-shaped coupler knuckles 32 and 32' of the car 30 and the adjacent car are maintained substantially horizontal with respect to the trackway, as described above, by means of the magnetic attraction between the magnets 35 and 39 with the upper surface 47 of each receptacle 43 resiliently urged against the respective ceiling 48 of the support structures 45. As long as the car 30 provides a pulling or dragging force between the two coupler knuckles 32 and 32', the projection 42*a* of the pulling coupler knuckle 32 will extend across the lower edge of the pulled coupler knuckle 32' such that the coupler 32' rides on or is engaged by the projection 42*a* of the coupler 32. The bottom view of FIG. 8 shows the projection 42*a* extending across the lower edge of the knuckle 32'. When the projection 42*a* engages the pulled coupler knuckle 32' the pulling coupler knuckle 32 is held at its lower position and prevented by the projection 42*a* from pivoting to its upper position. Thus, if adjacent coupled cars are pulled over the uncoupling magnet 41, as occurs during the normal running mode, the projection 42*a* will prevent the coupler knuckles 32 and 32' from disengaging from one another. Because of this feature, the uncoupling magnet 41 may preferably take the form of a permanent magnet rather than a more expensive electromagnet which requires an electrical circuit, control means, and a power source. An uncoupling permanent magnet is economical, compact, and simpler in construction when compared with an electromagnet and is more convenient to use.

In order to uncouple adjacent cars utilizing the coupler described above, the cars are moved to position the coupler 36 above and within the effective range of the uncoupling magnet 41, as shown in FIG. 3. The car 30 is then moved a small distance towards the adjacent car (to the left in FIGS. 3 and 7). The triangular formation 42 moves to take up the clearance in the coupling knuckle 32' defined by the gap C in FIG. 8. As a result, the upper portion 42*b* of the projection 42*a* disengages from and releases the triangular formation 42' to thereby permit the coupler knuckle 32 to be pivoted to its upper position by the uncoupling magnet 41 as described above. After the cars have been uncoupled, the car 30 may be moved out of the area of influence of the uncoupling magnet 41 to permit the coupling member 36 to be restored to its original horizontal position.

Figure 10:
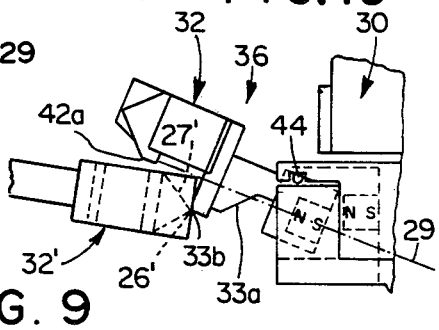
FIG. 10, is a partial side elevational view of a model railway car, similar to FIG. 9, with the coupler knuckle show at a short time subsequent to the position shown in FIG. 9.

The inclined ramp surface 33*a*, which is provided on the underside of the shaft 33, is provided to allow a car to push another, uncoupled car to a selected location and then separate from and leave the other car without recoupling. As shown in FIG. 9, two adjacent coupled cars are driven over the uncoupling magnet 41 such that the coupler member 36 is within the effective range of the magnet 41. The car 30 is driven a small distance toward the adjacent car in the direction of the arrow 55. The projection 42*a* disengages from and releases the triangular formation 42' allowing the coupling member 36 to move to its upper uncoupled position as shown in FIG. 9. The uncoupled car 30 may then be used to push the adjacent car by moving the car 30 still further in the direction of the arrow 55 toward the uncoupled adjacent car causing the coupler knuckle 32' to come into contact with and move beneath the inclined ramp surface 33*a* of the raised coupler 32. This contact urges the coupler 32' downward somewhat and causes its fore edge 26' to contact the receptacle 43 and align the inclined ramp surface 33*a* along the horizontal. With the cars so engaged, the car 30 may then be operated to push, as distinguished from pull, the adjacent car in the direction of the arrow 55 to a selected track area, as for example, a siding. As can be seen, the coupler of the present invention allows uncoupled cars to be pushed with a high degree of certainty. The cars are then stopped when they have been moved to the selected track area. In order to separate the car 30 from the other car, the car 30 is driven in the direction opposite to that of the arrow 55. The inclined ramp surface 33*a* slides on the upper surface of the triangular formation 42' of the coupler 32'. As the cars continue to separate, and end portion 33*b* of the inclined ramp surface 33*a* contacts and slides along the the upper inclined surface 27' of the coupler knuckle 32. When the end portion 33*b* reaches the fore end 26' of the coupler 32', the two couplers 32 and 32' are positioned as shown in FIG. 10, and, as shown therein, the projection 42*a* lies along a curved path defined by the distance extending between the projection 42*a* and the pivot 44 with this path intersecting the top of the coupler 32'. When the two couplers 32 and 32' separate, the coupler 32 pivots towards its lower position with the projection 42*a* contacting the top of the coupler 32' to prevent recoupling. Thus, the inclined ramp surface 33*a* permits an uncoupled car to push and leave another car at a predetermined track location without being recoupled to the car.

In the embodiment shown in FIG. 9, the coupler knuckle 32' of the acjacent car is resiliently supported on spring means or the like to thereby permit the coupler 32' to tilt or move downward somewhat when it is engaged by the coupler 32 of the car 30. As is apparent, the present invention may also be used in those cases where the coupler is of the fixed type, in which case the coupler knuckle 32' will not be moved downward when engaged with the coupler 32 of the car 30.

The coupler of the present invention for toy and model railway cars, which is provided with the projection 42*a* and the inclined ramp surface 33*a*, can be applied to the "Arnold-type" coupler, and to couplers of any conventional type which are designed to be coupled and uncoupled by motion in a vertical plane.

As is apparent from the above described embodiments, the present invention provides a number of advantages which greatly enhance the enjoyment and value to be derived from toy and model railway cars. The projection 42*a* provided on the lower side of the pivotable coupler member prevents unintentional uncoupling during the normal running of the cars and permits the use of an uncoupling permanent magnet rather than an uncoupling electromagnet. The permanent magnet is simple, reliable, inexpensive, and convenient to use when compared to an electromagnet. The inclined ramp surface 33*a* on the lower side of the support shaft provides a means by which a car may be pushed by another car without being coupled thereto and then separated from and left at a selected location, such as a siding, without recoupling to the pushing car. This latter feature is especially advantageous in that it prevents cars from being uncoupled to each other during delayed uncoupling (DU) operations.

The various railway type operations, which can be performed by an engine, such as coupling, normal running, uncoupling, the pushing to and leaving of cars at a preselected location, car shunting, and the like, can be performed easily and reliably and within the fundamental forward/reverse and speed control performance ranges of toy and model railway cars.

While the coupler of the present invention has been disclosed in combination with couplers utilizing magnets, it is readily apparent that the present invention may also be utilized with conventional "Arnold-type" couplers which utilize a spring to urge the coupler to the lower position. These couplers may be modified in accordance with the present invention without any substantial changes in their shape and structure to greatly improve their performance as described above. In addition, the coupler of the present invention can be used in combination with other conventional couplers and provide the advantages described.

While the present invention has been described in connection with the preferred embodiments, it is apparent to those skilled in the art the various changes and modifications can be made without departing from the spirit and the scope of the invention as defined in the appended claims and their legal equivalent.

I claim:

1. A coupler for toy and model railway cars comprising:

an elongated coupler member pivotally mounted on a coupler support means located at the end of a car;

said coupler member adapted to pivot between a lower position in which the longitudinal axis of said coupler member is substantially parallel to a trackway and an upper position in which the longitudinal axis of said coupler member is inclined relative to the trackway;

a "C"-shaped coupler knuckle secured to the end of said coupler member remote from the car for movement with said coupler member between said lower and said upper positions, said coupler knuckle, when in said lower position, adapted to couple with another, complementary coupler knuckle mounted on an adjacent car and, when moved to said upper position, adapted to uncouple from the other, complementary coupler knuckle;

first magnet means located on said coupler support and second magnet means located on said coupler member, said first and said second magnet means positioned relative to one another to urge said coupler member to said lower position;

said first-mentioned coupler knuckle and the other, complementary coupler knuckle, when coupled with one another, defining a clearance space therebetween to permit said first-mentioned car and the adjacent car to move toward and away from one another by a distance substantially equal to said clearance space; and projection means on said first-mentioned coupler knuckle adapted, when said first-mentioned coupler knuckle is coupled with the other, complementary couple knuckle, to releasably hold said first-mentioned knuckle in its lower position when said first-mentioned car and the adjacent car are moved away from one another to the extent permitted by said clearance space and adapted to disengage from and release the other, complementary knuckle when said first-mentioned car and the adjacent car are moved toward one another through said clearance space to thereby permit said coupler member to be pivoted to said upper position.

2. The coupler claimed in claim 1 wherein said projection means comprises:

a projection formed on a lower side of said knuckle and adapted to engage and hold the other, complementary knuckle.

3. The coupler claimed in claim 2, wherein said knuckle includes a triangular formation at a fore end;

said projection formed on the lower inside edge of said formation.

4. The coupler claimed in claim 3, wherein:

said coupler member has a lateral axis substantially perpendicular to said longitudinal axis with bearing shafts extending outward from the sides of said coupler member along said lateral axis; and said support means has bores formed therein to pivotally receive said bearing shafts to enable said coupler member to pivot between said upper and said lower positions.

5. The coupler claimed in claim 4, wherein:

said support means bores are elongated in the horizontal direction to permit lateral pivoting of said coupler member in a substantially horizontal plane when said coupler member is in said lower position.

6. The coupler claimed in claim 1 wherein said first and second magnet means comprises:

a first permanent magnet secured to one end of said coupler member with one pole thereof facing outwardly of said coupler member in the direction of said support means;

a second permanent magnet secured to said support means having one pole thereof facing said one pole of said first permanent magnet;

said one pole of said first magnet unlike said one pole of said second magnet;

wherein the resulting magnetic attraction between said unlike poles resiliently urges said coupler member to said lower position.

7. The coupler claimed in claim 6, further comprising:

an uncoupling magnet having an uncoupling pole on a trackway;

said uncoupling pole unlike said one pole of said first magnet;

wherein said uncoupling pole, when said coupler member is positioned in magnetic proximity to said uncoupling pole, attracts said one pole of said first magnet to create a torque to pivot said coupler member to said upper position.

8. The coupler claimed in claim 7, wherein:

said uncoupling magnet comprises a permanent magnet.

9. The coupler claimed in claim 6, wherein:

the other pole of said first magnet is located intermediate the end of said coupler member.

10. The coupler claimed in claim 9, further comprising:

an uncoupling magnet having an uncoupling pole on a trackway;

said uncoupling pole unlike said one pole of said first magnet;

wherein said uncoupling pole, when said coupler member is positioned in magnetic proximity to said uncoupling pole, attracts said one pole of said first magnet to create a torque to pivot said coupler member to said upper position.

11. The coupler claimed in claim 10, wherein:

said uncoupling magnet comprises a permanent magnet.

12. The coupler claimed in claim 6, wherein:

the other pole of said first magnet is located at the other end of said coupler member.

13. The coupler claimed in claim 12, further comprising:

an uncoupling magnet having an uncoupling pole on said trackway;

said uncoupling pole unlike said one pole of said first magnet;

wherein said uncoupling pole, when said coupler member is positioned in magnetic proximity to said uncoupling pole, attracts said one pole and repels said other pole of said first magnet to create a torque to pivot said coupler member to said upper position.

14. The coupler claimed in claim 13, wherein:

said uncoupling magnet comprises a permanent magnet.

15. The coupler claimed in claim 6, wherein:

said one pole of said first magnet faces outwardly of said coupler member in the direction of said support means along said longitudinal axis; and said one pole of said second magnet faces toward said one pole of said first magnet along an extension of said longitudinal axis when said coupler member is in said lower position.

16. The coupler claimed in claim 15, wherein:

said coupler member has a lateral axis substantially perpendicular to said longitudinal axis with bearing shafts extending outward from the sides of said coupler member along said lateral axis; and said support means has bores formed therein to pivotally receive said bearing shafts to enable said coupler member to pivot between said upper and said lower positions.

17. The coupler claimed in claim 16 wherein:

said support means bores are elongated in the horizontal direction to permit lateral pivoting of said coupler member in a substantially horizontal plane when said coupler member is in said lower position.

18. A coupler for toy and model railway cars comising:

an elongated coupler member pivotally mounted on a coupler support means located at the end of a car;

said coupler member adapted to pivot between a lower position in which the longitudinal axis of said coupler member is substantially parallel to a trackway and an upper position in which the longitudinal axis of said coupler member is inclined relative to the trackway;

a "C"-shaped coupler knuckle secured to the end of said coupler member remote from the car for movement with said coupler member between said lower and said upper positions, said coupler knuckle, when in said lower position, adapted to couple with another, complementary coupler knuckle mounted on an adjacent car and, when moved to said upper position, adapted to uncouple from the other, complementary coupler knuckle;

first magnet means located on said coupler support and second magnet means located on said coupler member, said first and said second magnet means positioned relative to one another to urge said coupler member to said lower position; and said coupler member having a ramp surface formed on a lower surface thereof facing the trackway, said ramp surface inclined relative to the longitudinal axis of said coupler member, and adapted to contact the end of the other, complementary knuckle when said coupler member is in its upper position to permit said first-mentioned car to push the adjacent car without being coupled thereto.

19. The coupler claimed in claim 18, wherein:

said has a lateral axis substantially perpendicular to said longitudinal axis with bearing shafts extending outward from the sides of said coupler member along said lateral axis; and said support means has bores formed therein to pivotally receive said bearing shafts to enable said coupler member to pivot between said upper and said lower positions.

20. The coupler claimed in claim 19 wherein:

said support means bores are elongated in the horizontal direction to permit lateral pivoting of said coupler member in a substantially horizontal plane when said coupler member is in said lower position.

21. The coupler claimed in claim 18, wherein said st and second magnet means comprises:

a first permanent magnet secured to one end of said coupler member with one pole thereof facing outwardly of said coupler member in the direction of said support means;

a second permanent magnet secured to said support means having one pole thereof facing said one pole of said first permanent magnet;

said one pole of said first magnet unlike said one pole of said second magnet;

wherein the resulting magnetic attraction between said unlike poles resiliently urges said coupler member to said lower position.

22. The coupler claimed in claim 21, further comprising:

an uncoupling magnet having an uncoupling pole on a trackway;

said uncoupling pole unlike said one pole of said first magnet;

wherein said uncoupling pole, when said coupler member is positioned in magnetic proximity to said uncoupling pole, attracts said one pole of said first magnet to create a torque to pivot said coupler member to said upper position.

23. The coupler claimed in claim 22, wherein:

said uncoupling magnet comprises a permanent magnet.

24. The coupler claimed in claim 21, wherein:

the other pole of said first magnet is located intermediate the ends of said coupler member.

25. The coupler claimed in claim 24, further comprising:

an uncoupling magnet having an uncoupling pole on said trackway;

said uncoupling pole unlike said one pole of said first magnet;

wherein said uncoupling pole, when said coupler member is positioned in magnetic proximity to said uncoupling pole, attracts said one pole of said first magnet to create a torque to pivot said coupler member to said upper position.

26. The coupler claimed in claim 25, wherein:

said uncoupling magnet comprises a permanent magnet.

27. The coupler claimed in claim 21, wherein:

the other pole of said first magnet is located at the other end of said coupler member.

28. The coupler claimed in claim 27, further comprising:

an uncoupling magnet having an uncoupling pole on said trackway;

said uncoupling magnet pole unlike said one pole of said first magnet;

wherein said uncoupling magnet pole, when said coupler member is in magnetic proximity of said uncoupling pole, attracts said one pole and repels said other pole of said first magnet to create a torque to pivot said coupler member to said upper position.

29. The coupler claimed in claim 18, wherein:

said uncoupling magnet comprises a permanent magnet.

30. The coupler claimed in claim 21 wherein:

said one pole of said first magnet faces outwardly of said coupler member in the direction of said support means along said longitudinal axis; and said one pole of said second magnet faces toward said one pole of said first magnet along an extension of said longitudinal axis when said coupler member is in said lower position.

31. The coupler claimed in claim 30, wherein:

said coupler member has a lateral axis substantially perpendicular to said longitudinal axis with bearing shafts extending outward from the sides of said coupler member along said lateral axis; and said support means has bores formed therein to pivotally receive said bearing shafts to enable said coupler member to pivot between said upper and lower positions.

32. The coupler claimed in claim 31, wherein:

said support means bores are elongated in the horizontal direction to permit lateral pivoting of said coupler member in a substantially horizontal plane when said coupler member is in said lower position.

* * * * *

UNITED STATES PATENT AND TRADEMARK OFFICE

CERTIFICATE OF CORRECTION

PATENT NO. : 4,195,742

DATED : April 1, 1980

INVENTOR(S) : Yoshihide Yumoto

It is certified that error appears in the above-identified patent and that said Letters Patent are hereby corrected as shown below:

Column 2, line 34, "an" should read --a--;

line 54, "magnet", second occurrence should read --member--.

Column 3, line 26, "overcome" should read --overcomes--.

Column 4, line 39, "show" should read --shown--;

line 42, "EMBODIMENT" should read --EMBODIMENTS--.

Column 5, line 55, after "32" insert a comma (--,--).

Column 7, line 12, "knucklers" should read --knuckles--;

line 28, "27" should read --37--;

line 32, "42" should read --41--;

line 55, after "uncoupling" insert a comma (--,--).

Column 8, line 22, "repeled" should read --repelled--;

line 36, "element" should read --magnet--.

Column 9, line 63, delete "the", first occurrence.

Column 10, line 41, "uncoupled" should read --recoupled--;

line 64, "the", second occurrence, should read --that--.

UNITED STATES PATENT AND TRADEMARK OFFICE

CERTIFICATE OF CORRECTION

PATENT NO. : 4,195,742

DATED : April 1, 1980

INVENTOR(S) : Yoshihide Yumoto

It is certified that error appears in the above-identified patent and that said Letters Patent are hereby corrected as shown below:

IN THE CLAIMS

Claim 9, line 3, "end" should read --ends--.

Claim 19, line 2, after "said" insert --coupler member--.

Claim 21, line 2, "st" should read --first--.

Claim 29, line 1, "18" should be --28--.

Signed and Sealed this

*First* Day of *July 1980*

[SEAL]

*Attest:*

SIDNEY A. DIAMOND

*Attesting Officer*

*Commissioner of Patents and Trademarks*